US007762833B2

(12) United States Patent
Neumetzler

(10) Patent No.: US 7,762,833 B2
(45) Date of Patent: Jul. 27, 2010

(54) CONTACT ELEMENT FOR A PLUG-TYPE CONNECTOR FOR PRINTED CIRCUIT BOARDS

(75) Inventor: Heiko Neumetzler, Berlin (DE)

(73) Assignee: ADC GmbH, Berlin (DE)

( * ) Notice: Subject to any disclaimer, the term of this patent is extended or adjusted under 35 U.S.C. 154(b) by 91 days.

(21) Appl. No.: 12/133,990

(22) Filed: Jun. 5, 2008

(65) Prior Publication Data

US 2009/0142941 A1 Jun. 4, 2009

(30) Foreign Application Priority Data

Jun. 5, 2007 (DE) ..... 10 2007 026 094

(51) Int. Cl.
*H01R 4/24* (2006.01)

(52) U.S. Cl. ..... 439/404; 439/907; 439/922

(58) Field of Classification Search ..... 439/404, 439/636, 907, 922
See application file for complete search history.

(56) References Cited

U.S. PATENT DOCUMENTS

| | | | | |
|---|---|---|---|---|
| 2,240,180 | A | | 4/1941 | Frank |
| 2,762,030 | A | * | 9/1956 | Scoville ..... 439/883 |
| 4,146,755 | A | | 3/1979 | Causse |
| 4,283,103 | A | | 8/1981 | Forberg et al. |
| 4,345,294 | A | | 8/1982 | Forberg et al. |
| 4,504,883 | A | | 3/1985 | Uchida et al. |
| 4,541,682 | A | | 9/1985 | Gerke et al. |
| 4,547,034 | A | | 10/1985 | Forberg et al. |
| 4,634,209 | A | | 1/1987 | Forberg et al. |
| 4,647,121 | A | | 3/1987 | Dolansky et al. |
| 4,741,711 | A | | 5/1988 | Singer, Jr. |
| 4,790,770 | A | | 12/1988 | Klaiber |
| 4,846,735 | A | | 7/1989 | Teichler et al. |
| 4,871,330 | A | | 10/1989 | Muller et al. |
| 4,975,066 | A | | 12/1990 | Sucheski et al. |
| 4,975,069 | A | | 12/1990 | Fedder et al. |
| 5,000,703 | A | | 3/1991 | Biederstedt et al. |
| 5,033,974 | A | | 7/1991 | Biederstedt et al. |
| 5,044,979 | A | | 9/1991 | Siemon et al. |
| 5,086,368 | A | | 2/1992 | Gerke et al. |

(Continued)

FOREIGN PATENT DOCUMENTS

DE 33 11 459 A1 10/1984

(Continued)

OTHER PUBLICATIONS

U.S. Notice of Allowance cited in U.S. Appl. No. 12/134,022, mailed Nov. 19, 2009 (5 pages) and Allowed Claims (4 pages).

(Continued)

*Primary Examiner*—Tho D Ta
(74) *Attorney, Agent, or Firm*—Merchant & Gould P.C.

(57) ABSTRACT

The invention relates to a contact element (10) for a plug-type connector for printed circuit boards, the contact element (10) having two connection sides, the one connection side being in the form of a contact for connecting wires and the other connection side being in the form of a contact for a printed circuit board, the contact element (10) further having an interface, via which electrical components can be connected, the interface being in the form of a plane contact face (13).

19 Claims, 6 Drawing Sheets

U.S. PATENT DOCUMENTS

| | | | | |
|---|---|---|---|---|
| 5,114,356 | A | 5/1992 | Taybl et al. | |
| 5,157,580 | A * | 10/1992 | Hegner et al. | 361/119 |
| 5,160,273 | A | 11/1992 | Carney | |
| 5,163,855 | A * | 11/1992 | Gerke et al. | 439/709 |
| 5,297,970 | A | 3/1994 | Carney | |
| 5,318,461 | A | 6/1994 | Frikkee et al. | |
| 5,451,170 | A | 9/1995 | Suffi | |
| 5,492,478 | A | 2/1996 | White | |
| 5,494,461 | A | 2/1996 | Bippus et al. | |
| 5,549,489 | A | 8/1996 | Baggett et al. | |
| 5,556,296 | A | 9/1996 | Dussausse et al. | |
| 5,575,689 | A | 11/1996 | Baggett et al. | |
| 5,596,475 | A | 1/1997 | Figueiredo et al. | |
| 5,627,721 | A | 5/1997 | Figueiredo et al. | |
| 5,647,760 | A | 7/1997 | Drach et al. | |
| 5,718,593 | A | 2/1998 | Figueiredo et al. | |
| 5,722,850 | A | 3/1998 | White | |
| 5,805,404 | A | 9/1998 | Kane et al. | |
| 5,844,785 | A | 12/1998 | Daoud et al. | |
| 5,923,238 | A | 7/1999 | Polzehl et al. | |
| 6,074,257 | A | 6/2000 | Fasano | |
| 6,193,556 | B1 | 2/2001 | Escane | |
| 6,346,005 | B1 | 2/2002 | Viklund et al. | |
| 6,402,542 | B1 * | 6/2002 | Jones | 439/404 |
| 6,556,411 | B1 | 4/2003 | Hoeft et al. | |
| 6,582,247 | B2 | 6/2003 | Siemon | |
| 6,654,223 | B1 | 11/2003 | Bippus et al. | |
| 6,799,988 | B2 | 10/2004 | Mansur | |
| 6,821,153 | B2 | 11/2004 | Otto et al. | |
| 6,994,582 | B1 | 2/2006 | Carney et al. | |
| 7,018,229 | B2 | 3/2006 | Otto et al. | |
| 7,037,118 | B2 | 5/2006 | Neumetzler et al. | |
| 7,056,147 | B2 | 6/2006 | Arias et al. | |
| 7,121,870 | B1 | 10/2006 | Chen | |
| 7,165,983 | B1 | 1/2007 | Fasce et al. | |
| 7,207,818 | B1 | 4/2007 | Barthes et al. | |
| 7,223,115 | B2 | 5/2007 | Hashim et al. | |
| 7,270,551 | B2 | 9/2007 | Busse et al. | |
| 7,322,847 | B2 | 1/2008 | Hashim et al. | |
| 7,335,049 | B2 | 2/2008 | Alarcon et al. | |
| 7,335,069 | B1 | 2/2008 | Williams et al. | |
| 7,410,369 | B2 | 8/2008 | Busse et al. | |
| 7,462,076 | B2 | 12/2008 | Walter et al. | |
| 7,583,488 | B2 | 9/2009 | Neumetzler et al. | |
| 2003/0077934 | A1 | 4/2003 | Mansur | |
| 2005/0106942 | A1 | 5/2005 | Neumetzler et al. | |
| 2006/0030198 | A1 | 2/2006 | Carney et al. | |
| 2007/0064373 | A1 | 3/2007 | Neumetzler et al. | |
| 2008/0305661 | A1 * | 12/2008 | Neumetzler | 439/92 |
| 2008/0305674 | A1 * | 12/2008 | Neumetzler | 439/395 |
| 2008/0305684 | A1 | 12/2008 | Neumetzler et al. | |
| 2008/0305686 | A1 * | 12/2008 | Neumetzler | 439/630 |
| 2009/0011633 | A1 | 1/2009 | Busse et al. | |
| 2009/0130920 | A1 * | 5/2009 | Muller et al. | 439/719 |

FOREIGN PATENT DOCUMENTS

| | | | |
|---|---|---|---|
| DE | 36 14 592 | C1 | 7/1987 |
| DE | 39 17 270 | | 11/1990 |
| DE | 44 23 339 | C1 | 9/1995 |
| DE | 296 01 998 | U1 | 5/1996 |
| DE | 102 57 308 | B3 | 7/2004 |
| DE | 103 17 621 | A1 | 11/2004 |
| DE | 10 2004 017 605 | | 10/2005 |
| DE | 10 2004 061 681 | | 7/2006 |

OTHER PUBLICATIONS

U.S. Notice of Allowance cited in U.S. Appl. No. 12/134,000 mailed Jan. 11, 2010 (5 pages) and Allowed Claims (1 page).

* cited by examiner

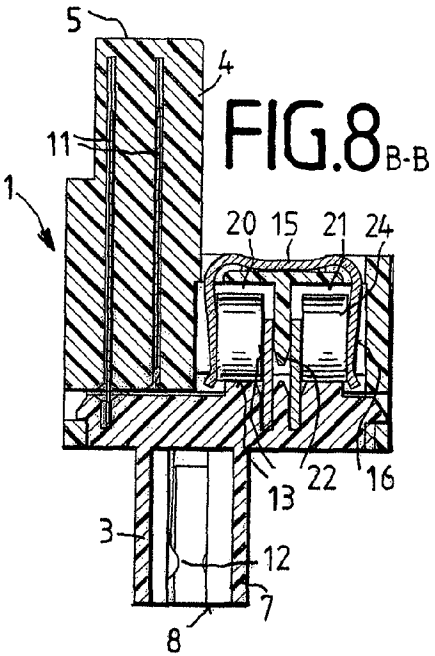
FIG.8B-B
1
5
4
11
20
15
21
24
16
22
13
12
7
8
3
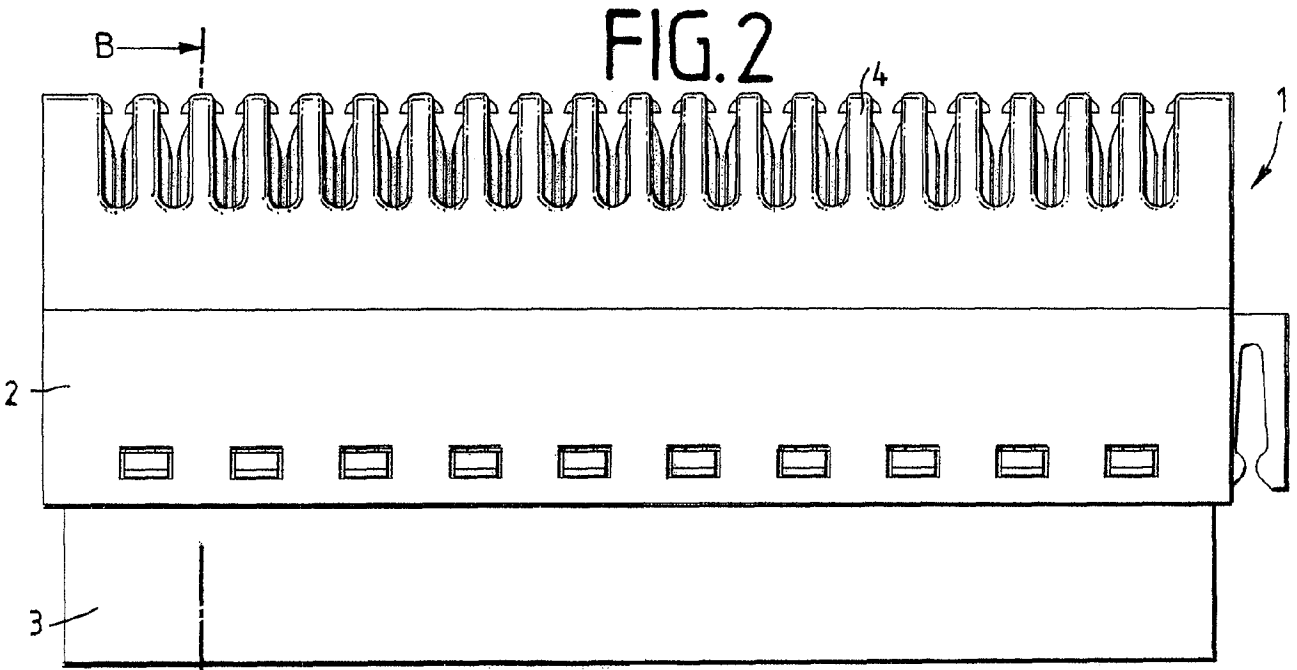
FIG.2
1
4
B
2
3
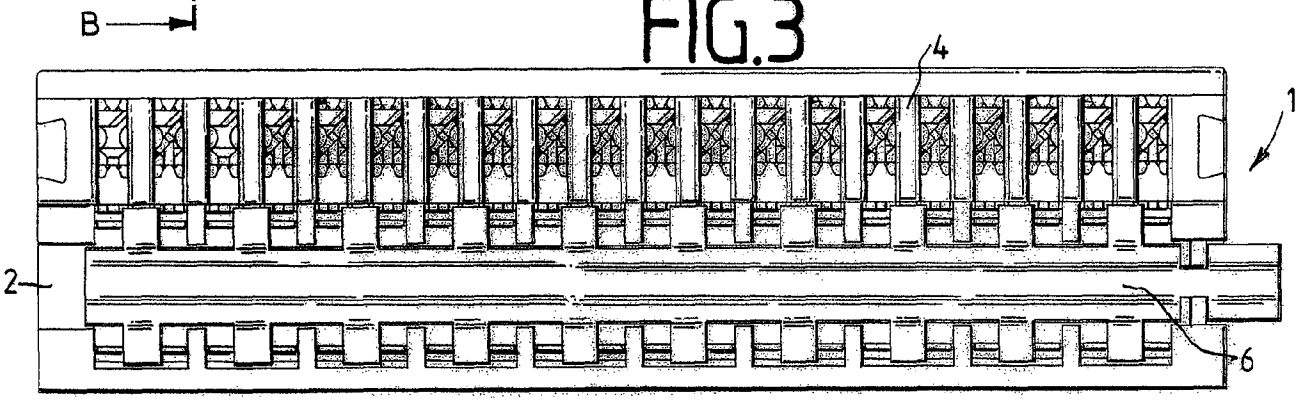
FIG.3
1
4
6
B
2

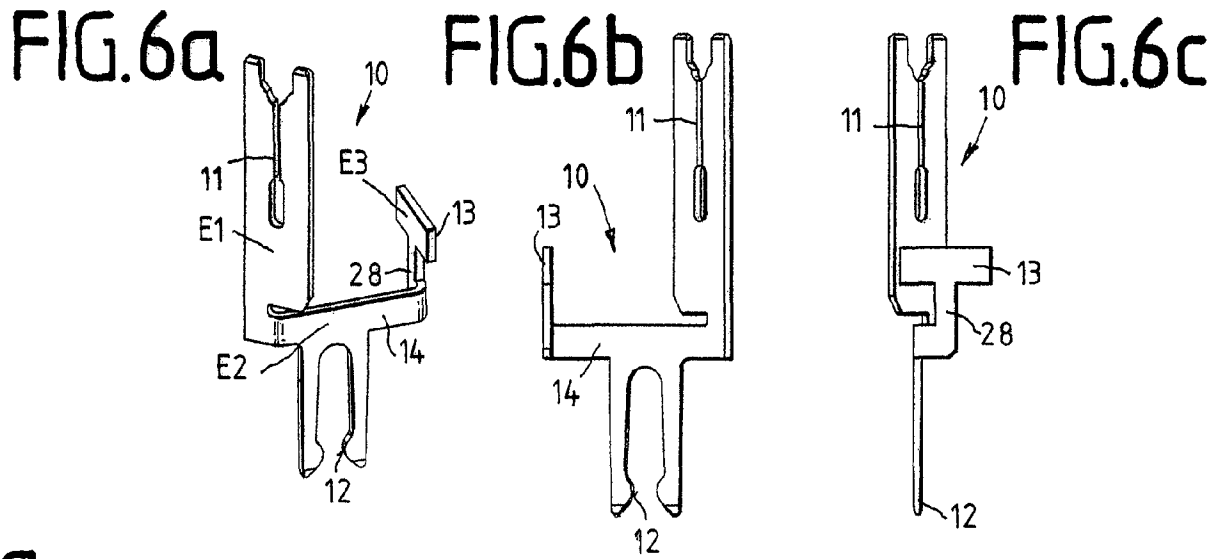
FIG.6a
FIG.6b
FIG.6c
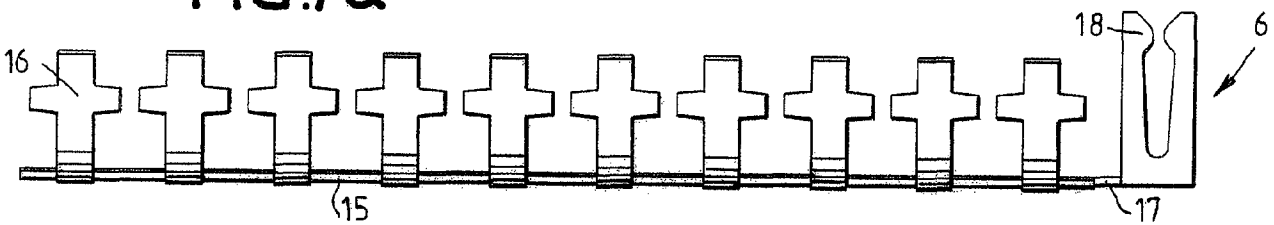
FIG.7a
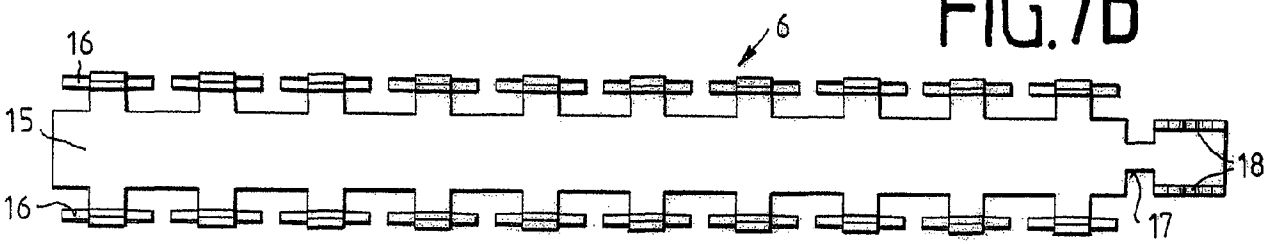
FIG.7b
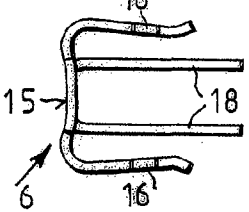
FIG.7c

CONTACT ELEMENT FOR A PLUG-TYPE CONNECTOR FOR PRINTED CIRCUIT BOARDS

BACKGROUND OF THE INVENTION

The invention relates to a contact element for a plug-type connector for printed circuit boards.

DE 10 2004 017 605 B3 has disclosed a plug-type connector for printed circuit boards, comprising a number of contact elements, the contact elements each having two connection sides, one connection side being in the form of an insulation displacement contact for connecting wires, and the other connection side being in the form of a fork contact for making contact with connection pads on a printed circuit board, and a plastic housing, into which the insulation displacement contacts of the contact elements can be inserted, at least one lower edge of the insulation displacement contact being supported on the plastic housing, with the result that the contact elements are held in the plastic housing such that they cannot fall out in the event of connection forces occurring on the insulation displacement contacts, the plastic housing comprising at least one chamber-shaped region, and the fork contacts being accommodated completely in the longitudinal direction of the plastic housing, the contact element having two parts, the first part comprising the insulation displacement contact, and the second part comprising the fork contact, in each case one contact limb being arranged on both parts and the two contact limbs forming an isolation contact, the plastic housing having two pieces, the first housing part accommodating the insulation displacement contact, and the second housing part accommodating the fork contact, and both housing parts being latched to one another, the insulation displacement contact being supported on a slit clamping web of the second housing part, said fork contact lying in the slit of the clamping web, being supported in the interior of the second housing part and being clamped in by the first housing part. In this case, the isolation contact represents an interface via which, in addition to isolating plugs, surge protection plugs or magazines can also be connected.

SUMMARY OF THE INVENTION

The invention is based on the technical problem of providing a contact element for a plug-type connector for printed circuit boards which allows for improved integration of surge arresters.

The contact element for a plug-type connector for printed circuit boards has two connection sides, the one connection side being in the form of a contact for connecting wires and the other connection side being in the form of a contact for a printed circuit board, the contact element further having an interface, via which electrical components, preferably two-pole surge arresters, can be connected, the interface being in the form of a plane contact face.

The contact for the printed circuit board is preferably in the form of a fork contact, which is particularly tolerant to faults with respect to fluctuations in the printed circuit board thickness or positional displacements of the contact elements.

In a further preferred embodiment, the contact element is formed in one piece, which, in addition to simple manufacture, also ensures improved transmission performance.

In a further preferred embodiment, the contact for connecting the wires is in the form of an insulation displacement contact, which is preferably positioned at an angle of 45° (+/−5°) to the fork contact.

In a further preferred embodiment, the fork contact is aligned perpendicular to the contact face of the contact element.

In a further preferred embodiment, the contact face of the contact elements is bent back with respect to the contact for the printed circuit board such that the plane of the contact face is perpendicular to the plane of the contact for the printed circuit board.

The contact for connecting the wires and the contact for the printed circuit board are preferably accessible from mutually opposite sides.

BRIEF DESCRIPTION OF THE DRAWINGS

The invention will be explained in more detail below with reference to a preferred exemplary embodiment. In the figures:

FIG. 2 shows a front view of the plug-type connector,

FIG. 3 shows a plan view of the plug-type connector,

FIGS. 6*a-c* show various perspective illustrations of a contact element,

FIG. 7*a* shows a front view of a grounding comb,

FIG. 7*b* shows a plan view of the grounding comb,

FIG. 7*c* shows a side view of the grounding comb,

FIG. 8 shows a cross section of the plug-type connector along the section line B-B shown in FIG. 2.

DETAILED DESCRIPTION OF THE PREFERRED EMBODIMENT(S)

Figure 1:
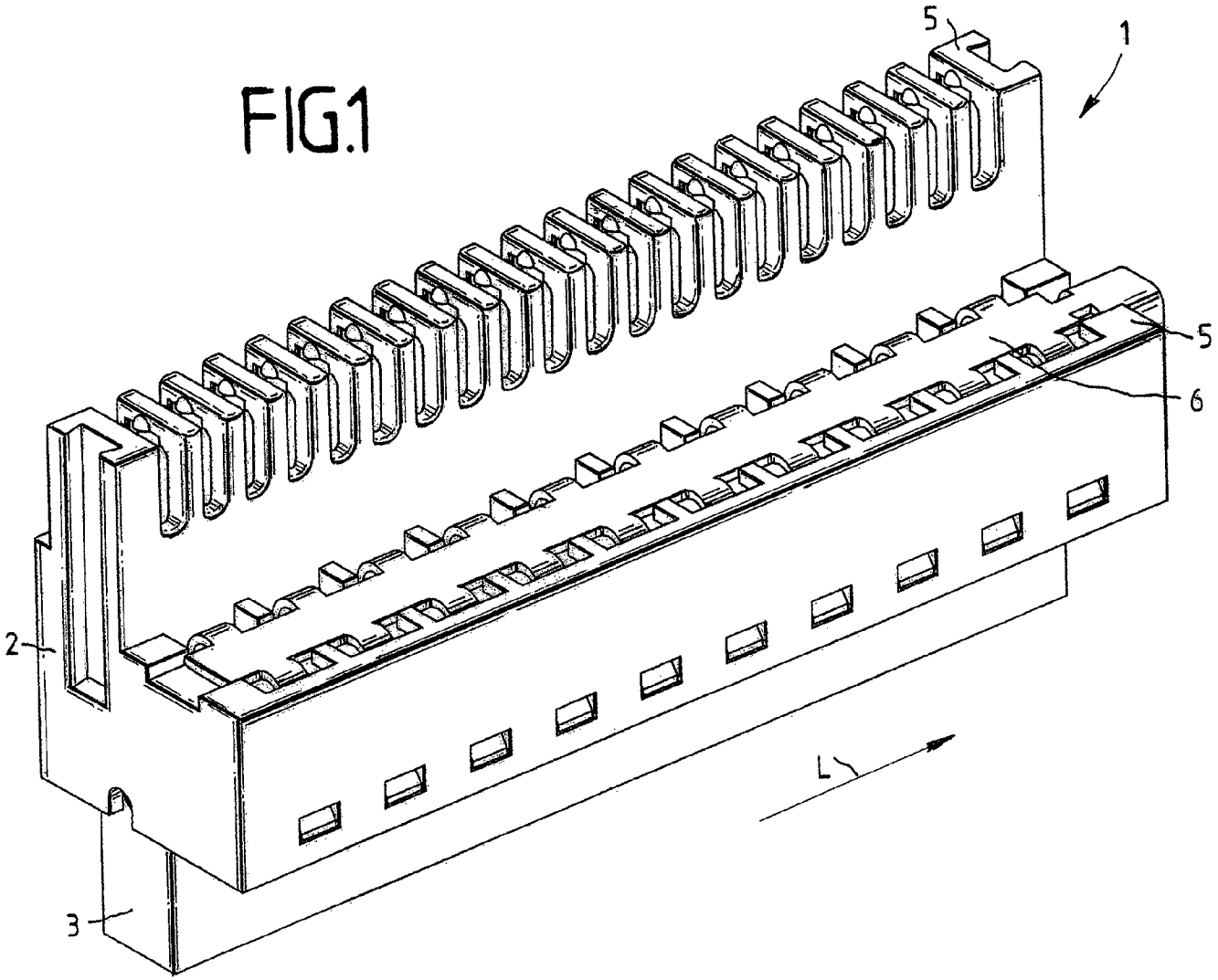
FIG. 1 shows a perspective front view of a plug-type connector for printed circuit boards.
Figure 4:
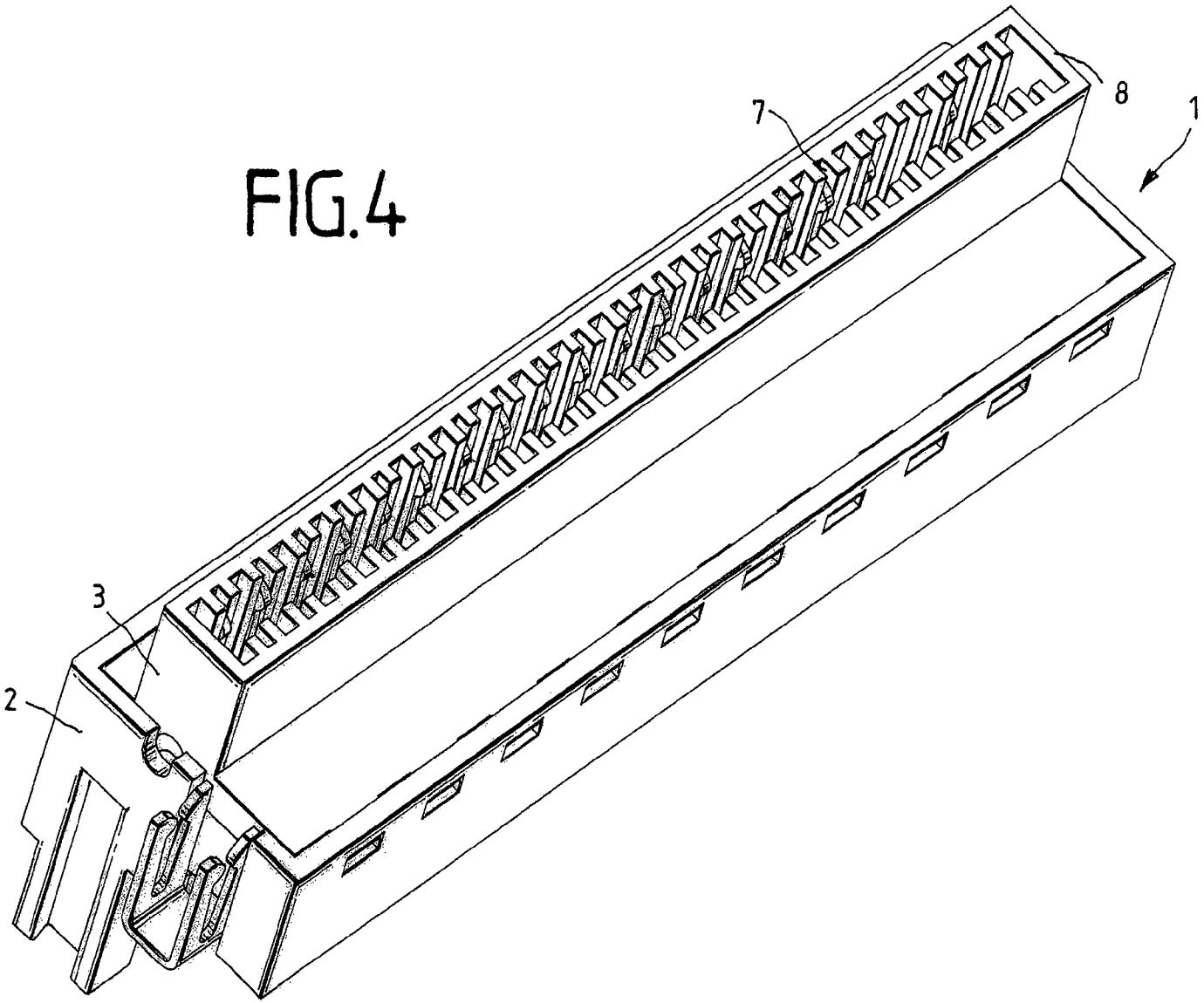
FIG. 4 shows a perspective view from below of the plug-type connector.

The plug-type connector 1 for printed circuit boards comprises a first housing part 2 and a second housing part 3, which are preferably connected to one another by a latching connection. The first housing part 2 has raised webs 4, between which insulation displacement contacts 11 of contact elements 10 (see FIGS. 6*a-c*) are guided. The webs 4 are arranged in a row which extends in the longitudinal direction L. In this case, webs 4 are arranged laterally offset with respect to the center line, the other side being positioned deeper. On this side of the upper side 5, the first housing part 2 has openings, into which a grounding comb 6 is inserted (see FIGS. 7*a-c*). The second housing part 3 is formed with guides 7, in which the fork contacts 12 of the contact elements 10 are guided, preferably the guides 7 completely accommodating the fork contacts 12, i.e. said fork contacts not protruding beyond the underside 8 of the second housing part 3.

Before the construction of the plug-type connector 1 is explained in more detail, the construction of the contact element 10 should first be explained in more detail with reference to FIGS. 6*a-c* and that of the grounding comb 6 with reference to FIGS. 7*a-c*.

The one-piece contact element 10 comprises an insulation displacement contact 11, a fork contact 12 and a contact face 13. In this case, the insulation displacement contact 11 and the fork contact 12 are aligned in opposite directions to one another, i.e. the insulation displacement contact 11 is accessible from the upper side 5 of the first housing part 2 and the fork contact 12 is accessible from the underside 8 of the second housing part 3. In this case, the plane E1 of the insulation displacement contact 11 is at an angle of 45° with respect to the plane E2 of the fork contact 12. A web-shaped extension 14 protrudes from the fork contact 12, this web-shaped extension then being adjoined by the contact face 13 via a web 28. The web 28 and the contact face 13 in this case form a T-shaped contact. In this case, the plane E3 of the contact face 13 is at a right angle with respect to the plane E2 of the fork contact 12. The width of the contact face 13 in this case ensures that the contact face 13 makes reliable contact with a two-pole surge arrester.

The grounding comb 6 comprises a carrier 15, which extends in the longitudinal direction L and on which laterally sprung contact lugs 16 are arranged. In this case, the contact lugs 16 are precisely opposite one another on the two longitudinal sides of the carrier 15. The sprung contact lugs 16 have a cruciform shape, with the result that, owing to the tapering towards the carrier 15, a sufficient spring effect is ensured. At the lower end, the contact lugs 16 are bent slightly outwards in order to therefore facilitate the plug-in operation into the first housing part 2.

A double fork contact 18, which extends in the same direction as the contact lugs 16, is arranged on a front side 17 of the carrier 15. The double fork contact 18 has the advantage that, in comparison with a single fork contact, more current is transmitted. There is also simpler fitting when latching-on the plug-type connector.

Figure 5:
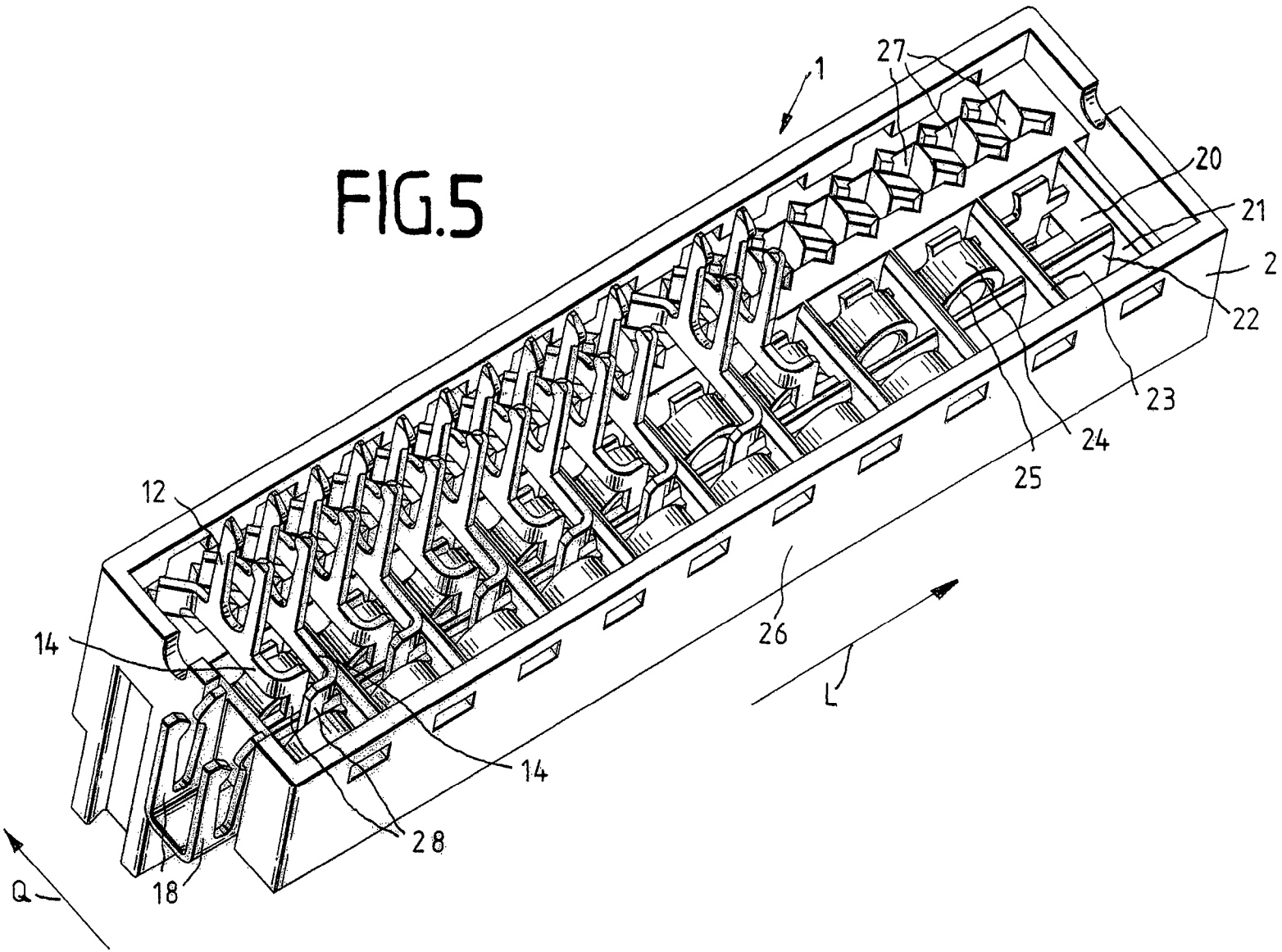
FIG. 5 shows a perspective view from below without the housing part.

FIG. 5 illustrates the plug-type connector 1 in a view from below without the second housing part 3. In the interior, the first housing part 2 is formed with receptacles 20, 21 and 27. In this case, the first housing part 2 comprises ten receptacles 20, ten receptacles 21 and twenty receptacles 27, the receptacles 20 and 21 each being arranged in a row extending in the longitudinal direction L. In this case, in each case one receptacle 20 and one receptacle 21 are associated with one another as a pair and are separated from one another by a wall 22, the two receptacles associated with one another as a pair extending in the form of a receptacle pair 20, 21 in the transverse direction Q. The receptacle pairs 20 and 21 of a row are separated from one another in the longitudinal direction L by a wall 23. Two-pole surge arresters 24 are arranged in the receptacles 20 and 21, which surge arresters essentially have a cylindrical shape. The two-pole surge arresters 24 are each formed on the base and lid with a contact (pole) 25 in the form of a circular ring, contact then being made with said surge arresters by the contact face 13 and the contact lugs 16 from both pole sides. For this purpose, the contact face 13 of a contact element 10 and a contact lug 16 of the grounding comb 6 in each case protrude into a receptacle 20, 21, the two contact faces 13 bearing, in the receptacles 20, 21, in each case on both sides against the wall 22 (see also FIG. 8). In this case, the contact faces 13 are relatively rigid. The contact elements 10 for the receptacles 20 and 21 also have different shapes. In the inserted state, the insulation displacement contacts 11 of all the contact elements 10 are aligned parallel to one another. The same applies to the fork contacts 12. However, the extension 14 of the contact elements 10 for the receptacles 21 is longer than that of the contact elements 10 for the receptacles 20. Furthermore, the bent-back portion of the contact face 13 is turned around. On the basis of the illustration in FIG. 5, the contact face 13 of the contact element 10 for the receptacle 20 is bent back from the extension 14 by 90° towards the right, whereas the contact face 13 of the contact element 10 with the longer extension for the receptacle 21 is bent back from the extension 14 through 90° towards the left.

In addition, twenty receptacles 27 for accommodating the insulation displacement contacts 11 are provided which likewise extend in the longitudinal direction L. In this case, in each case two receptacles 27 are associated with one receptacle pair 20, 21, aligned in the transverse direction Q.

FIG. 5 shows, in the left-hand region, a housing part 2 which has been completely fitted with contact elements 10. In the right-hand region, six contact elements 10 have been removed in the first three receptacle pairs 20, 21 in order to make the receptacles 20, 21 and 27 more visible. Furthermore, for this purpose the first receptacle pair 20, 21 is illustrated in the right-hand region of the housing part 2 and the receptacle 21 without the surge arresters 24 is illustrated in the second receptacle pair 20, 21 from the right. In the case of two receptacle pairs, 20, 21, in order to better illustrate the different lengths of the extensions 14 and the different bends in the webs 28 for the contact faces 13, in each case one contact element 10 with a longer and shorter extension 14 has been removed.

The two-pole surge arresters 24 are in this case aligned in the receptacles 20, 21 in such a way that the base and lid faces are aligned parallel to the side face 26 of the first housing part 2. In this case, note should be made of the fact that the receptacles 20 and 21 of a pair do not necessarily need to be aligned, but embodiments are also possible where these are offset with respect to one another.

Figure 9:
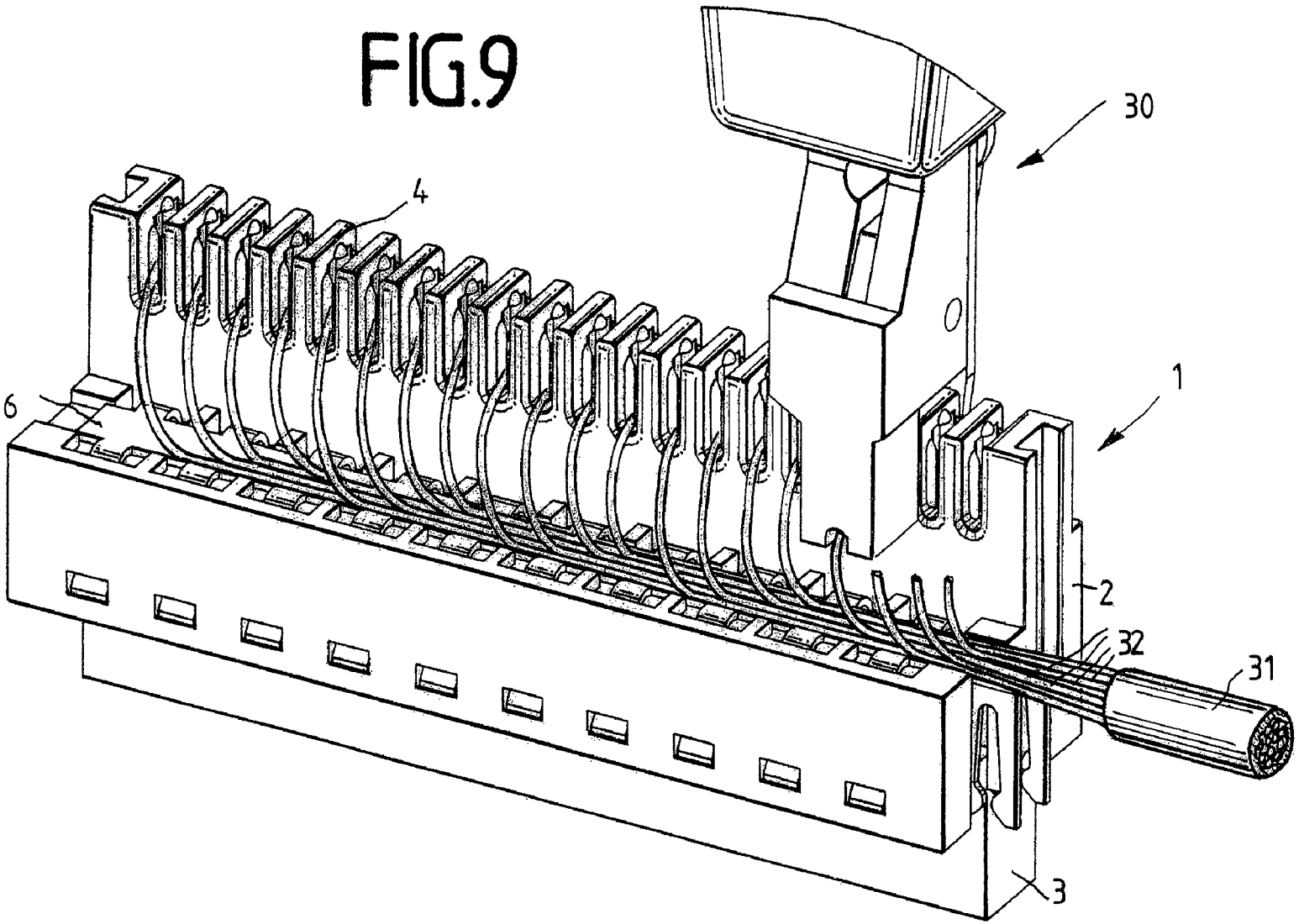
FIG. 9 shows a perspective front view of the plug-type connector with the positioning tool placed thereon.

Finally, FIG. 9 illustrates the plug-type connector 1 with a positioning tool 30 for wires 32 for making contact with the insulation displacement contacts 11. The webs 4 for the insulation displacement contacts 11 are raised with respect to the grounding comb 6 in such a way that the lifting operation of the positioning tool 30 is not impeded and sufficient space can be made available for the run of a cable 31 of the wires 32 with which contact has been made above the grounding comb 6.

LIST OF REFERENCE SYMBOLS

1 Plug-type connector
2 First housing part
3 Second housing part
4 Webs
5 Upper side
6 Grounding comb
7 Guides
8 Underside
10 Contact elements
11 Insulation displacement contact
12 Fork contact
13 Contact face
14 Extension
15 Carrier
16 Contact lugs
17 Front side
18 Double fork contact
20 Receptacles
21 Receptacles
22 Wall
23 Wall
24 Surge arresters
25 Contact
26 Side face
27 Receptacles
28 Web
30 Positioning tool
31 Cables
32 Wires
E1 Plane
E2 Plane
E3 Plane L Longitudinal direction Q Transverse direction

The invention claimed is:

1. A contact element for a plug-type connector for printed circuit boards, the contact element comprising:

two connection sides, one of the connection sides being in the form of a contact for connecting wires and the other connection side being in the form of a contact for a printed circuit board, the contact element further having an interface, via which electrical components can be connected, wherein the interface defines a planar contact face that is oriented perpendicular to the contact for the printed circuit board.

2. The contact element as claimed in claim 1, wherein the contact element is formed in one piece.

3. The contact element as claimed in claim 1, wherein a web-shaped extension protrudes from the contact for the printed circuit board, which web-shaped extension is adjoined by the planar contact face via a web.

4. The contact element as claimed in claim 1, wherein the contact face of the contact element is bent back from the contact for the printed circuit board so that the plane of the planar contact face is perpendicular to the plane of the contact for the printed circuit board.

5. The contact element as claimed in claim 1, wherein the contact for connecting the wires and the contact for the printed circuit board are accessible from mutually opposite sides.

6. The contact element as claimed in claim 1, wherein the contact for the printed circuit board is in the form of a fork contact.

7. The contact element as claimed in claim 6, wherein the contact for connecting the wires is in the form of an insulation displacement contact.

8. The contact element as claimed in claim 7, wherein the insulation displacement contact is positioned at an angle of 45° to the fork contact.

9. A contact element for a plug-type connector for printed circuit boards, the contact element comprising:

a first connection side forming a wire connection contact;

a second connection side forming a printed circuit board connection contact; and an interface via which electrical components can be connected to the contact element, the interface defining a planar contact face that connects to the printed circuit board connection contact via a web-shaped extension, the web-shaped extension and the planar contact face defining a T-shape.

10. The contact element as claimed in claim 9, wherein the printed circuit board connection contact is in the form of a fork contact.

11. The contact element as claimed in claim 9, wherein the wire connection contact is in the form of an insulation displacement contact.

12. The contact element as claimed in claim 9, wherein the contact element is formed in one piece.

13. The contact element as claimed in claim 9, wherein the wire connection contact is positioned at an angle of 45° to the printed circuit board connection contact.

14. A contact element for a plug-type connector for printed circuit boards, the contact element comprising:

a first connection side forming a wire connection contact;

a second connection side forming a printed circuit board connection contact; and an interface via which electrical components can be connected to the contact element, the interface defining a planar contact face;

wherein the wire connection contact is accessible from an upper side of a connector housing and the printed circuit board connection contact is accessible from an underside of the connector housing.

15. The contact element as claimed in claim 14, wherein the printed circuit board connection contact is in the form of a fork contact.

16. The contact element as claimed in claim 14, wherein the wire connection contact is in the form of an insulation displacement contact.

17. The contact element as claimed in claim 14, wherein the contact element is formed in one piece.

18. The contact element as claimed in claim 14, wherein the wire connection contact is positioned at an angle of 45° to the printed circuit board connection contact.

19. The contact element as claimed in claim 14, wherein a web-shaped extension protrudes from the printed circuit board connection contact to adjoin the planar contact face of the interface.

* * * * *